United States Patent [19]

Munk

[11] Patent Number: 4,867,670

[45] Date of Patent: Sep. 19, 1989

[54] APPARATUS FOR PRODUCING PRESS SHAPED BODIES

[75] Inventor: Edmund Munk, Oberstenfeld, Fed. Rep. of Germany

[73] Assignee: Werzalit -Werke J.F. Werz KG, Stuttgart, Fed. Rep. of Germany

[21] Appl. No.: 102,345

[22] Filed: Sep. 29, 1987

Related U.S. Application Data

[60] Continuation of Ser. No. 841,596, Mar. 20, 1986, abandoned, which is a division of Ser. No. 728,849, Apr. 30, 1985.

[30] Foreign Application Priority Data

Oct. 10, 1984 [EP] European Pat. Off. ..... 84112135.3

[51] Int. Cl.[4] ..... B29C 43/14

[52] U.S. Cl. ..... 425/347; 264/120; 264/294; 425/351; 425/353; 425/354; 425/359; 425/415; 425/422; 425/443

[58] Field of Search ..... 425/193, 195, 357–359, 425/406–408, 414–416, 422, 441, 443, 345, 347, 351, 353, 354; 264/119, 120, 294, 297.8, 325

[56] References Cited

U.S. PATENT DOCUMENTS

| | | | |
|---|---|---|---|
| 630,397 | 8/1899 | Niedringhaus | 264/294 |
| 3,354,248 | 11/1967 | Haas et al. | 264/119 |
| 3,664,785 | 5/1972 | Marshall et al. | 425/414 |
| 3,764,244 | 10/1973 | Hurley et al. | 425/415 |
| 3,975,127 | 8/1976 | Munk et al. | 425/193 |
| 3,997,643 | 12/1976 | Munk et al. | 264/120 |
| 4,073,848 | 2/1978 | Kuehn | 264/120 |
| 4,106,884 | 8/1978 | Jegelka | 425/359 |
| 4,153,399 | 5/1979 | DeSantis | 425/414 |
| 4,233,006 | 11/1980 | Panas | 425/407 |
| 4,490,321 | 12/1984 | Klinkaü | 425/407 |

*Primary Examiner*—James Housel
*Attorney, Agent, or Firm*—Michael J. Striker

[57] ABSTRACT

In an apparatus for producing shaped bodies of non-swelling mixture, of fiber materials with a heat hardenable binding medium, the shaped body of a complex shape can be formed so that at its visible side seams are not formed during pressing, by means of an additional pressing of a pre-pressed mixture in a one piece cavity press member before it reaches its final shape.

13 Claims, 2 Drawing Sheets

APPARATUS FOR PRODUCING PRESS SHAPED BODIES

This is a continuation of application Ser. No. 841,596, filed Mar. 20, 1986 now abandoned which is now in turn a division of application Ser. No. 728,849 filed on Apr. 30, 1985.

BACKGROUND OF THE INVENTION

The present invention relates to a method of and an arrangement for producing pressed shaped bodies of a non-swelling mixture of fibrous materials mixed with a heat-hardenable binding agent.

Methods and arrangements of the abovementioned general type are known in the art. The mixture is pre-pressed (rough pressed) and subsequently hardened in a hot press to its final shape. A first lower part of a pressing tool is placed into a press and is pressed there by closing of the press with simultaneous pre-pressing in an upper part of the pressing tool. Then instead of the first lower part of the pressing tool, a second lower part of the pressing tool is placed. Such a method and an arrangement are disclosed, for example, in the German Pat. No. 2,309,975 which corresponds to the U.S. Pat. Nos. 3,975,127 and 3,997,643. The non-swelling mixture is composed frequently of ligno-cellulose containing fiber materials such as comminuted and dried wood chips, bagasse fibers, etc., mixed with a heat-hardenable synthetic resin such as melamine resin, urea formaldehyde resin or phenol formaldehyde resin. Instead of the comminuted and dried wooden or bagasse fibers, fibers of other materials can be used such as glass fibers, stone wool, alone or in a mixture with one another, with admixture of respective advantageously organic binding agent.

The novel methods and the respective arrangements for performing the methods are provided for producing of relatively small shaped bodies, such as for example discs with a diameter of 5 cm, or grid-like lattice elements composed of rings and connecting webs with small wall thickness such as for example ornamental grate or coloring grate elements. The known methods are also successful for production of these products when their components have a uniform thickness. However, the known methods lead to qualitatively not satisfying products when the components of the products to be produced, for example, a covering grate element have webs which are offset in stepped manner, for example having different depths. When these products are produced in accordance with known methods, a seam can form at their side which is provided with webs of different depths and which simultaneously is a visible side of the product. Removal of the seam is very expensive or not possible at all.

SUMMARY OF THE INVENTION

Accordingly, it is an object of the present invention to provide a method of and an arrangement for producing pressed shaped bodies, which makes possible pressing of products with webs having different depth so that no seam is developed on the visible side of the product.

In keeping with these objects and with others which will become apparent hereinafter, one feature of the present invention resides, briefly stated, in that a pre-pressed (rough pressed) mixture is pressed in a second lower part of a pressing tool during repeated closing of the press, then is hot-pressed there and thereby hardened.

In accordance with another solution of the invention, the pre-pressed mixture is pressed during repeated closing of the press in the second lower part of the press tool, and thereafter, the second lower part of the press tool is moved under another upper part of the press tool and by lowering of this upper part the pre-pressed mixture is hot-pressed and thereby hardened.

In accordance with another feature of the invention, the heatable lower part of the press tool has depressions corresponding to the shape of the shaped body, the upper part of the tool also has a space provided with a controllable raising and lowering device and is movable over the heated lower part of the press tool.

In still a further embodiment of the present invention the heatable lower part of the tool has depressions corresponding to the shape of the shaped body, the upper part of the pressing tool also has spaces provided with controllable raising and lowering device, and a further raisable and lowerable as well as heatable upper part of the press tool is arranged above the heatable lower part and provided with raised portions at its surface facing toward the lower part of the pressing tool.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figures 1A, 1B, 1C:
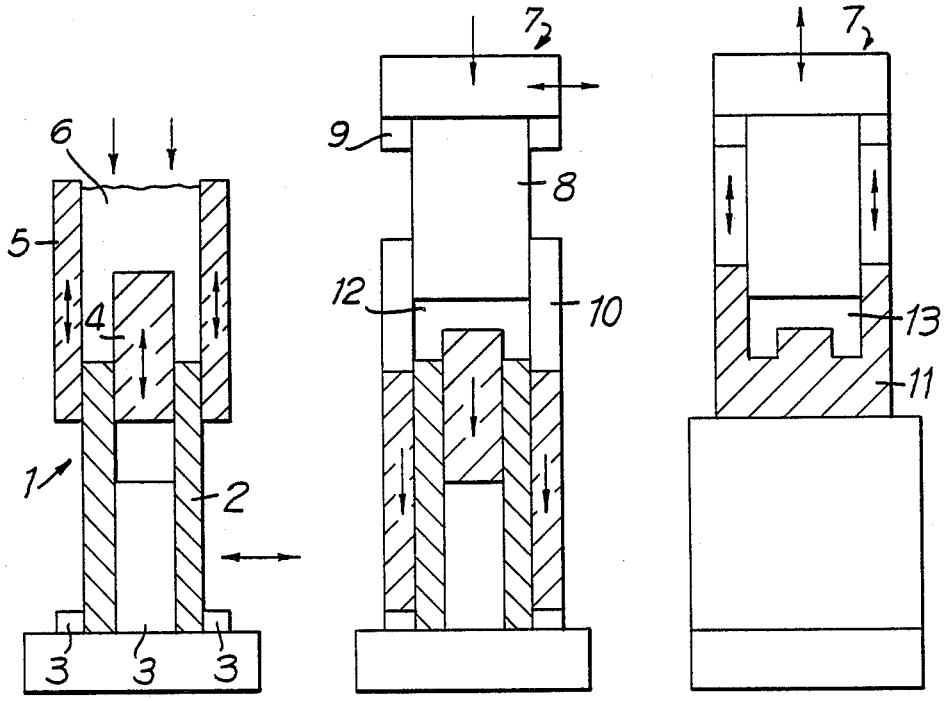
FIGS. 1(*a*) to 1(*c*) are views showing an arrangement for producing pressed shaped bodies in accordance with one embodiment of the present invention.

An arrangement in accordance with one embodiment is shown in FIGS. 1*a*–1*c*. As can be seen from FIG. 1*a* it has at left side a first lower part 1 of a pressing tool. The lower part 1 has a stationary bottom 2, an intermediate member 4 and an outer member 5. The intermediate member 4 and the outer member 5 are movable relative to the stationary bottom 2 and their movement is limited by stops 3.

The intermediate member 4 and the outer member 5 together form a filling space for receiving a mixture from which a shaped body with stepped offset, differently deep webs must be pressed. For the sake of simplicity, FIG. 1 shows only one individual tool. When the inventive arrangement is used for example for pressing lattice cover elements, the arrangement is formed as a multiple tool which includes a plurality of identical individual tools connected of one piece with one another.

As can be seen from FIG. 1*b*, the lower part 1 of the pressing tool is shown in its pressing position in which it has been moved under an upper part 7 of the pressing tool. The horizontally displaceable upper part 7 of the pressing tool also has a liftable and lowerable intermediate part 8 as well as an outer part 10 which is movable relative to the intermediate part 8 and its movement is limited by stops 9.

As can be seen from FIG. 1*c*, the upper part 7 of the pressing tool moves over a second lower part 11 of the pressing tool and is shown in its pressing position.

The arrangements shown in FIGS. 1*a*–1*c* operate in the following manner:

A mixture to be pressed so as to form a shaped body is filled in the filling space 6. Then the first lower part 1 is moved under the upper part 7 of the pressing tool. By lowering of the upper part 7, the mixture accommodated in the first lower part 6 is compressed and pressed into the hollow space 12 of the upper part 7. This condition is shown in FIG. 1*b*. After this, the upper part 7 moves upwardly and to the right, whereby it reaches the second lower part 11 of the pressing tool. The first lower part 6 can simultaneously be moved back to its initial position as shown in FIG. 1*a*. Then the uper part 7 is lowered toward the second lower part 11 of the pressing tool and the pre-pressed shaped body is pressed from the hollow space 12 into a hollow space 13 of the second lower part 11 of the pressing tool as shown in FIG. 1*c*. Simultaneously, the shaped body is finally pressed and hardened by supply of heat. For this purpose, the upper part 7 and the second lower part 11 of the pressing tool or only the second lower part 11 can be provided with heating. The finished shaped body is subsequently discharged by not shown ejectors. As can be seen from the drawing, the lower part 11 is a one-piece part, in which the hollow space 13 is open only at its one upper side and closed at its other sides.

Figure 2B:
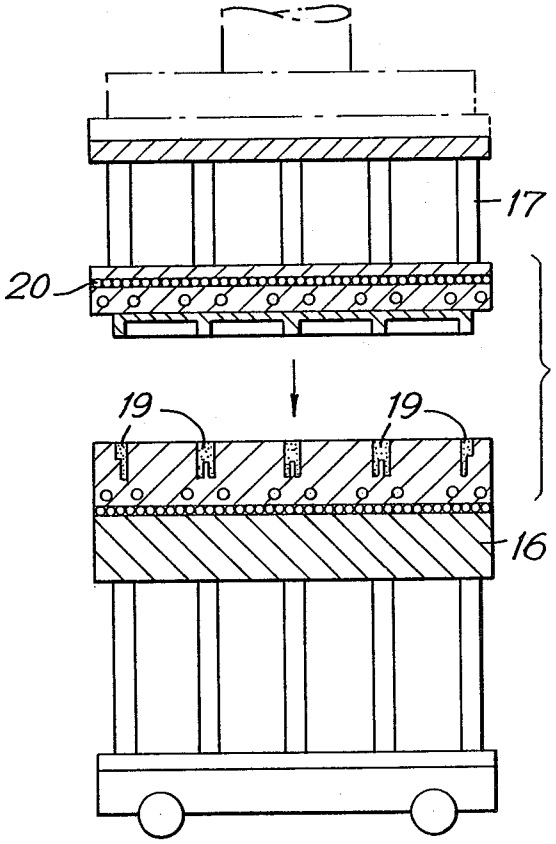
FIGS. 2(*a*) and 2(*b*) are views corresponding to the views of FIGS. 1(*a*) to 1(*c*) but showing the arrangement in accordance with another embodiment of the invention.
Figure 2A:
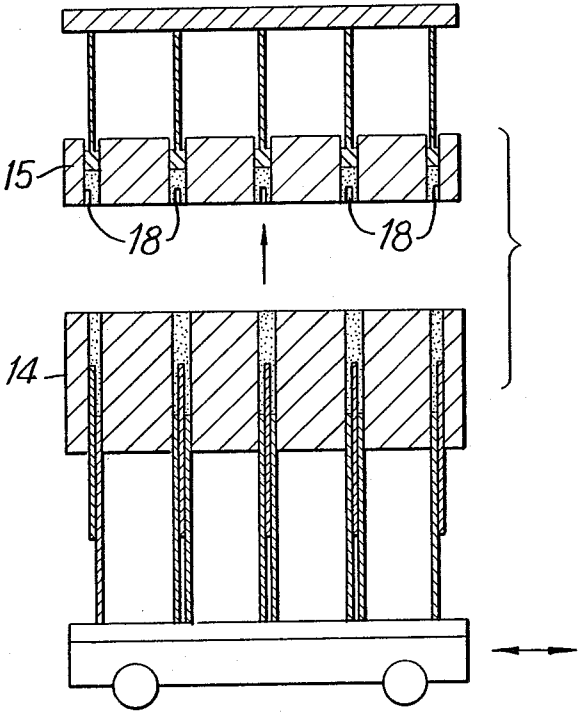

FIGS. 2*a* and 2*b* show an arrangement in accordance with another embodiment of the invention. It has a first lower part 14 and a first upper part 15, and a second lower part 16 and a second upper part 17 of a pressing tool. The upper parts 15, 17 and the lower parts 14, 16 of the pressing tool are formed in a known manner, such as for example illustrated in the embodiment of FIG. 1. The pressing tool shown in FIG. 2 differs from the pressing tool of FIG. 1 in that it is formed as a tool for a complete shaped body composed of a plurality of webs.

The arrangement shown in FIGS. 2*a*–2*b* operates in the following manner:

The first lower part 14 is filled with a pressing mass in its position in which it is displaced to the left from the position shown in FIG. 2*a*. Then the first lower part 18 is moved under the first upper part 15 of the pressing tool. This is shown in FIG. 2*a*. Then the first upper part 15 is lowered onto the first lower part 14 of the press, and a mixture accommodated in the first lower part 14 is pre-pressed and transferred into a hollow space 18 in the first upper part 15. Then the second lower part 16 is moved under the first upper part 15 of the pressing tool. During a subsequent lowering of the first upper part 15, the compressed mixture is transferred from the hollow space 18 of the first upper part 15 into the hollow space 19 of the second lower part 16 of the pressing tool. Then the second lower part 16 is moved under the second upper part 17 of the pressing tool. This position is shown in FIG. 2*b*.

After lowering of the second upper part 17, the pre-pressed shaped body accommodated in its hollow spaces 19 is finally pressed and then hardened by supply of heat. The heat is generated by switching on of heaters 20. The finished shaped body is then removed from the hollow spaces 19 by not shown ejectors. The second lower part 16 is a one-piece part with the hollow space 19 which is open only at its one side.

It will be understood that each of the elements described above, or two or more together, may also find a useful application in other types of constructions differing from the types described above.

While the invention has been illustrated and described as embodied in a method of and arrangement for producing shaped bodies, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. An apparatus for producing shaped bodies from a mixture of fiber materials with a hardenable binder medium, said apparatus comprising a pressing tool which has a first lower press means with a filling space for accommodating and pre-pressing the mixture; a second lower press means formed as a one-piece member provided with a cavity for receiving and pressing the pre-pressed mixture; and an upper press means which is liftable and lowerable and also horizontally movable between one position in which said upper press means is located above said first lower press means and moves vertically toward said first lower press means to pre-press the mixture and to receive the pre-pressed mixture from said first lower press means, and another position in which said upper press means is located above said second lower press means for transferring the pre-pressed mixture into said cavity of said second lower press means for pressing and hardening the pre-pressed mixture in said cavity of said one-piece second lower press means, so that no seam is produced on a shaped body; and means for transferring the pre-pressed mixture from said first lower press means into said upper press means.

2. An apparatus as defined in claim 1, wherein said second lower press means of said pressing tool includes means for heating said second lower press means.

3. An apparatus as defined in claim 1, wherein said upper press means is provided with a frame with lifting and lowering means.

4. An apparatus as defined in claim 1, wherein said first lower press means is not provided with heating means to heat said first lower press means.

5. An apparatus as defined in claim 1, wherein said upper press means has a depression arranged so that the pre-pressed mixture can be pressed from said first lower press means into said depression of said upper press means.

6. An apparatus as defined in claim 1, wherein said first lower press means has a frame provided with lifting and lowering means.

7. An apparatus for producing shaped bodies from a mixture of fiber materials with a hardenable binder medium, said apparatus comprising a pressing tool which has a first lower press means with a filling space for accommodating and pre-pressing the mixture, said first lower press means being horizontally movable between a filling position in which said space is filled with the mixture, and a pre-pressing position; a first upper press means which is liftable and lowerable about said first lower press means and moves vertically toward said first lower press means in the pre-pressing position to pre-press the mixture in said first lower press means and then to receive the pre-pressed mixture from said first lower press means into said first upper press means; means for transferring the pre-pressed mixture from said first lower press means into said first upper press means; a second lower press means formed as a one-piece member having a cavity and is horizontally movable under said first upper press means so that said first upper press means moves toward said second lower press means to transfer the pre-pressed mixture into said cavity of said second one-piece lower press means; and a second upper press means which is liftable and lowerable about said second lower press means when said second lower press means has moved horizontally from said first upper press means to said second upper press means and moves toward said second lower press means for pressing and hardening the pre-pressed mixture in said cavity of said one-piece second lower press means so that no seam is produced on a shaped body.

8. An apparatus as defined in claim 7, wherein said second lower press means includes means for heating said second lower press means.

9. An apparatus as defined in claim 7, wherein said first upper press means has a frame provided with lifting and lowering means.

10. An apparatus as defined in claim 7, wherein said second upper press means includes a frame having lifting and lowering means, and said second upper press means further includes means for heating said second upper press means.

11. An apparatus as defined in claim 7, wherein said second upper press means has a surface arranged to face toward said second lower press means and being provided on said surface with a raised portion.

12. An apparatus as defined in claim 7, wherein said first lower press means has a frame provided with lifting and lowering means.

13. An apparatus as defined in claim 7, wherein said first upper press means has a depression into which the pre-pressed mixture is transferred from said first lower press means.

* * * * *